US011085269B2

(12) United States Patent
Garay et al.

(10) Patent No.: US 11,085,269 B2
(45) Date of Patent: Aug. 10, 2021

(54) STINGER FOR COMMUNICATING FLUID LINE WITH DOWNHOLE TOOL

(71) Applicant: Weatherford Technology Holdings, LLC, Houston, TX (US)

(72) Inventors: Serge Garay, Osserain (FR); Glenn A. Bahr, The Woodlands, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 44 days.

(21) Appl. No.: 16/552,878

(22) Filed: Aug. 27, 2019

(65) Prior Publication Data

US 2021/0062610 A1 Mar. 4, 2021

(51) Int. Cl.

| | |
|---|---|
| ***E21B 34/08*** | (2006.01) |
| ***E21B 34/10*** | (2006.01) |
| *E21B 43/16* | (2006.01) |

(52) U.S. Cl.

CPC ..... *E21B 34/08* (2013.01); *E21B 34/10* (2013.01); *E21B 43/16* (2013.01); *E21B 2200/05* (2020.05)

(58) Field of Classification Search

CPC ..... E21B 34/08; E21B 43/16; E21B 2200/05
See application file for complete search history.

(56) References Cited

U.S. PATENT DOCUMENTS

| | | | | |
|---|---|---|---|---|
| 3,606,927 | A * | 9/1971 | True et al. | E21B 34/06 166/384 |
| 5,518,072 | A * | 5/1996 | McTernaghan | E21B 23/02 166/115 |
| 9,745,825 | B2 | 8/2017 | Jones et al. | |
| 2004/0026087 | A1 | 2/2004 | Dennistoun et al. | |
| 2008/0000642 | A1 | 1/2008 | Mailand et al. | |
| 2009/0050333 | A1 | 2/2009 | Smith et al. | |
| 2009/0205831 | A1 | 8/2009 | Jacob | |
| 2009/0277643 | A1* | 11/2009 | Mondelli | E21B 34/107 166/319 |
| 2010/0078176 | A1 | 4/2010 | Christie | |
| 2013/0056222 | A1 | 3/2013 | Smith et al. | |
| 2014/0224503 | A1 | 8/2014 | Smith et al. | |

FOREIGN PATENT DOCUMENTS

| | | | |
|---|---|---|---|
| WO | 2006133351 | A3 | 12/2006 |
| WO | 2016128752 | A1 | 8/2016 |

OTHER PUBLICATIONS

International Search Report issued in co-pending PCT Application No. PCT/US2020/043821, dated Oct. 14, 2020, 14 pages.

* cited by examiner

*Primary Examiner* — D. Andrews
(74) *Attorney, Agent, or Firm* — Blank Rome LLP

(57) ABSTRACT

A stinger is stabbed into a bore opening of a downhole tool to communicate fluid from a fluid line to the downhole tool. The stinger body defines a bore that communicates with the bore opening of the tool when the stinger body is installed in the downhole tool. An external surface of the stinger body can seal and lock inside an inside surface of the tool's bore opening when the stinger body is installed therein. The stinger body has a flow passage connected to the fluid line. A stinger port in the external surface of the stinger body is in communication with the flow passage and positions in fluid communication with a tool port inside the tool's bore opening so fluid can be communicated to the downhole tool.

25 Claims, 9 Drawing Sheets

STINGER FOR COMMUNICATING FLUID LINE WITH DOWNHOLE TOOL

BACKGROUND OF THE DISCLOSURE

In some completions, a control fluid (or other injectable) fluid may be delivered downhole to a mandrel, a safety valve, or some other tool. In many installations, a fluid line, such as a capillary or other communication line, cannot be run outside the tubing string. Instead, the capillary line must be run down the tubing string to deliver the fluid from the surface to the downhole tool.

For example, FIG. 1 illustrates a schematic view of tubing 10 having a downhole tool 50, such as a surface-controlled subsurface safety valve. A capillary line 20 hangs from a hanger 40 at a wellhead 14 runs down through the tubing 10, which can be a casing string, production string, etc. A hydraulic system 22 at surface communicates with the capillary line 20 to control the safety valve 50. Hydraulic pressure from the hydraulic system 22 maintains the safety valve 50 open, allowing production from the formation to flow uphole past the valve 50, through the wellhead 14, and out a flow line 16 to a destination.

During normal operation, the hydraulic system 22 maintains hydraulic pressure in the fluid line 20. Under certain conditions, however, the hydraulic system 22 releases the hydraulic control so that the safety valve 50 closes and prevents flow uphole. Using techniques known in the art, for example, the hydraulic system 22 monitors flow line pressure sensors and automatically closes the safety valve 50 in response to an alarm condition requiring shut-in. To close the safety valve 50, the hydraulic system 22 removes the hydraulic pressure applied to the safety valve 50 by exhausting the hydraulic fluid from the valve 50 via the fluid line 20. The valve 50 then automatically closes, preventing production fluid from perforations 12 or the like from communicating uphole to the wellhead 14.

In this and other arrangements, the downhole tool 50 includes a communication passageway for facilitating fluid communication between a coupling of the capillary line 20 with a port of the downhole tool 50. Depending on the downhole tool 50 used, the port can then communicate the fluid with a hydraulic chamber used to control a flapper valve or other operable mechanism. In other implementations, the port can communicate with an injection tubing string for further delivery of the fluid downhole.

A typical method for delivering the fluid to the downhole tool 50 uses a stinger or a receptacle positioned in the center of the flow bore of the tool 50 so the communication line 20 can make the connection to the tool 50 there. For example, a receptacle can be positioned in the flow bore of the tool 50, and a stinger of the communication line 20 can be stabbed into receptacle for the connection to communicate the fluid. In a reverse arrangement, a stinger can be positioned in the flow bore of the tool 50, and a Staubli-style receptacle on the communication line 20 can be stabbed down over the receptacle. However, both of these methods result the internal flow area of the tool's flow bore being restricted and turbulent.

In a brief example, a surface controlled subsurface safety valve 50 illustrated in FIG. 2A installs in a well having existing hardware for a surface-controlled valve and can be deployed in the well using standard wireline procedures. When run in the well, the valve 50 lands in an existing landing nipple 10 after an inoperable safety valve has been removed.

The safety valve 50 has a housing 52 with a landing portion 58 and a safety valve portion 60. The landing portion 58 can use locking dogs movable on the housing 52 between engaged and disengaged positions relative a groove 18 in the surrounding landing nipple 10 to hold the valve 50 in the nipple 10. The valve portion 60 has a flapper 68 rotatably disposed on the housing 52. The flapper 68 rotates on a pivot pin, and a torsion spring biases the flapper 68 to a closed position.

To operate the landing portion 58, an upper sleeve 56 movably disposed within the housing 52 can be mechanically moved between upper and lower locked positions against the bias of a spring. In the upper locked position as shown in FIG. 1A, the upper sleeve 320's distal end moves the locking dogs 58 to the engaged position so that they engage the landing nipple's groove 18.

To operate the valve portion 60, a lower sleeve 64 movably disposed within the housing 52 can be hydraulically moved from an upper position to a lower position against the bias of a spring 66. When hydraulically moved to the lower position (not shown), the sleeve 64 moves the flapper 68 open. In the absence of sufficient hydraulic pressure, however, the bias of the spring 66 moves the sleeve 64 to the upper position shown in FIG. 2A, permitting the flapper 68 to close by its own torsion spring about its pivot pin.

In deploying the valve 50, a conventional wireline tool (not shown) couples to the profile in the upper end of the valve's housing 52 and lowers the valve 50 to the landing nipple 10. When in position, the wireline tool actuates the landing portion 58 by moving the upper sleeve 56 upward against the bias of spring to push out the locking dogs 58 from the housing 52 so that they engage the landing nipple's groove 18. Once landed, upper and lower chevrons 55 on the housing 52 also seal above and below any existing port 11 in the landing nipple 10 provided for the removed valve.

With the valve 50 landed in the nipple 10, operators lower a capillary string 20 downhole to the valve 50. This capillary string 20 can be hung from a capillary hanger (not shown) at the surface. The capillary string 20 may include blade centralizers 22 to facilitate lowering the string 20 downhole. The string 20's distal end passes into the valve's housing 52, and a hydraulic connector 30 is used to couple the string 20 to the valve 50.

In particular as shown in FIG. 2B, a female member 32 of the hydraulic connector 30 on the distal end mates with a male member 34 on the valve 50. The connector 30 can be an automatic connector, such as available from Staubli of France.

Once the members 32/34 are connected as shown, the capillary string 20 communicates with an internal port 42 defined in a projection 40 within the valve 50. Operators then inject pressurized hydraulic fluid through the capillary string 20. As the fluid reaches the internal port 42, it can engage an internal piston 62 to move the piston 62 downward against the bias of the spring 66 and shift the inner sleeve 64 to force open the flapper 68.

In this way, the valve portion 60 can operate in a conventional manner. As long as hydraulic pressure is supplied to the piston 62 via the capillary string 20, for example, the inner sleeve 64 maintains the flapper 68 open, thereby permitting fluid communication through the valve's housing 52. When hydraulic pressure is released due to an unexpected up flow or the like, the spring 66 moves the inner sleeve 64 away from the flapper 68, and the flapper 68 is biased shut by its torsion spring, thereby sealing fluid communication through the valve's housing 52.

As can be seen, the projection 40 in the center of the tool's throughbore 54 to receive the connector 30 can significantly obstruct flow though the tool 50. Moreover, current methods use a single-sealing, small diameter seals in the connector 30, and locking of the connector 30 may be achieved with an internal ball system. Also, flowing pressure tries to disconnect the connector 30, which uses a ball connector or snap ring to hold the connector's components in place. Consequently, the seals in the existing solutions may have a shorter lifespan than desired, complicating the task of keeping the downhole tool installed for the required operational life of an installation.

The subject matter of the present disclosure is directed to overcoming, or at least reducing the effects of, one or more of the problems set forth above.

SUMMARY OF THE DISCLOSURE

According to the present disclosure, a stinger is used for communicating fluid between a fluid line and a downhole tool. The downhole tool is disposed with tubing, and the fluid line runs through the tubing. The downhole tool has a tool bore for passage of tubing flow therethrough. The tool bore defines a tool port in an internal surface of the tool bore.

The stinger comprises a body having a proximal end and a distal end and defining a body bore for passage of the tubing flow therethrough between the proximal and distal ends. The body has a flow passage therein in communication with the fluid line. The body also has a stinger port in an external surface of the body. The stinger port is in communication with the flow passage.

The body is configured to insert at least partially into the tool bore of the downhole tool. The body bore is configured to communicate with the tool bore for the passage of the tubing flow therethrough, and the stinger port in the external surface is configured to position in fluid communication with the tool port in the internal surface.

The flow passage can comprise a first connection disposed toward the proximal end, where the first connection is configured to connect the flow passage to the fluid line. The flow passage can comprise: a chamber defined in the body; a first portion of the flow passage communicating the first connection with the chamber; and a second portion of the flow passage communicating the chamber with the external port.

The first portion of the flow passage noted above can comprise a first conductor having a first connected end and a first free end, where the first connected end is disposed in communication with the first connection to the fluid line and where the first free end is disposed in the chamber. The second portion of the flow passage noted above can comprise a second conductor disposed at least partially in the body bore of the body, where the second conductor has a second free end and a second connected end, where the second free end is disposed in the chamber, and where the second connected end is disposed in communication with the stinger port.

The body bore of the body noted above can comprise a second connection disposed off a central axis in the body bore. The flow passage of the body can include an internal channel defined in the body. The second connection can be connected to the second connected end of the second conduit and can communicate through the internal channel with the stinger port.

The body of the stinger can comprise first and second annular seals disposed about the external surface of the body. The stinger port can be exposed in the external surface between the first and second seals. In this case, the distal end of the body can comprise a sleeve disposed thereabout that is movable on the distal end between covered and uncovered positions relative to the first and second annular seals. The sleeve can comprise a dog engageable with an internal groove in the tool bore of the downhole tool.

The stinger can further comprise a lock disposed on the external surface of the body that is engageable in an internal groove in the tool bore. For example, the body can define first and second external grooves. The lock can comprise: a collar movably disposed on the body; and a dog disposed on the collar and being shiftable between an extended condition and a retracted condition on the collar. The collar in an intermediate position on the body can have the dog shifted in the extended condition between first and second external grooves. The collar can be moved in either direction from the intermediate position having the dog shifted by the tool bore to the retracted condition into either of the first and second external grooves.

The lock can also comprise a first biasing element and a second biasing element. The first biasing element can have a first bias, which acts against the collar in a first direction toward the intermediate position and is reactive in a second, opposite direction away from the intermediate position. The second biasing element can have a second bias, which acts against the collar in the second direction toward the intermediate position. The second bias can be stopped at the intermediate position and is reactive in the first direction away from the intermediate position.

During the insertion of the body into the tool bore in the first direction, the dog can be disposed on the collar in the intermediate position and can be shifted to extended condition engages a shoulder in the tool bore. The collar can act against the first bias until the dog shifts to the retracted condition in the first external groove. During removal of the body from the tool bore in the second direction, the dog disposed on the collar in the intermediate position and shifted to extended condition can engage the internal groove in the tool bore. The collar can act against the second bias until the dog shifts to the retracted condition in the second external groove.

The proximal end of the body can be connected to the fluid line, and the body bore at the proximal end can define a plurality of flutes communicating the body bore out of the body.

The distal end of the stinger can be cylindrical, whereby a first diameter of the body bore of the stinger at the distal end can mate with a second diameter of the tool bore of the tool.

According to the present disclosure, an apparatus is used downhole in tubing having tubing flow. The apparatus comprises a tool and a stinger. The tool is disposed with the tubing and has a tool bore for passage of the tubing flow therethrough. The tool bore defines a tool port in an internal surface of the tool bore. The stinger of any of the above configurations is connected to a fluid line. The stinger is disposed in the tubing and defines a flow bore for passage of the tubing flow therethrough. The stinger is configured to stab at least partially into the tool bore and is configured to communicate fluid between the fluid line and the tool port of the tool.

The tool can comprise an injection mandrel, with the tool port in communication with a valve of the injection mandrel and configured to control injection of chemical from the fluid line.

The tool can comprise a valve being operable by the fluid from the fluid line to open and closed fluid communication through the tool bore. The valve can comprise: a receptacle defined in the tool bore configured to receive a distal end of the stinger, the receptacle having the tool port; a flapper disposed in the tool bore and being pivotable between opened and closed positions relative to the tool bore; a sleeve disposed in the tool bore and being movable therein to pivot the flapper between the opened and closed positions; and a piston connected to the sleeve and being in fluid communication with the tool port.

The tool disposed with the tubing can be disposed on the tubing or disposed in the tubing.

According to the present disclosure, a method communicating fluid between a fluid line and a downhole tool disposed with tubing, the downhole tool having a tool bore for passage of tubing flow therethrough, the tool bore defining a tool port in an internal surface of the tool bore, the method comprising: connecting a stinger to the fluid line; stabbing the stinger in the tool bore of the downhole tool; positioning a stinger port in an external surface of the stinger in fluid communication with the tool port in the internal surface of the tool bore; communicating the fluid through a flow passage in the stinger between the fluid line and the stinger port in fluid communication with the tool port of the downhole tool; and permitting the passage of the tubing flow of the tool bore through a stinger bore defined through the stinger.

Stabbing the stinger in the tool bore of the downhole tool can comprise engaging a lock on the stinger in the tool bore. Stabbing the stinger in the tool bore of the downhole tool can comprise uncovering seals of the stinger port by retracting a sleeve on the stinger against a shoulder in the tool bore.

Permitting the passage of the tubing flow of the tool bore through the stinger bore defined through the stinger can comprise positioning a cylindrical distal end of the stinger in the tool bore and aligning the stinger bore with the tool bore and can further comprise communicating the stinger bore with the tubing through a flute in a proximal end of the stinger connected to the fluid line.

The foregoing summary is not intended to summarize each potential embodiment or every aspect of the present disclosure.

DETAILED DESCRIPTION OF THE DISCLOSURE

Figure 1:
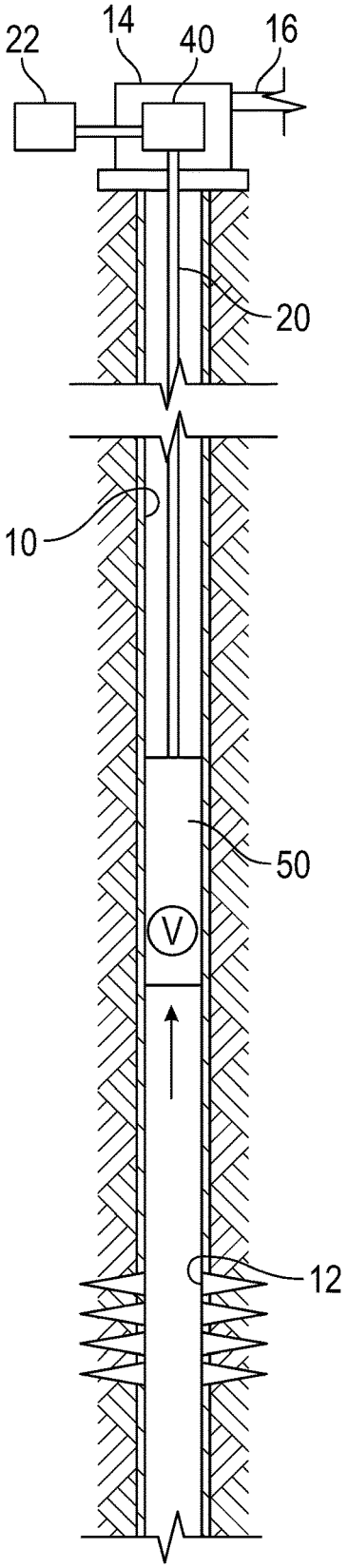
FIG. 1 (Prior Art)
FIG. 1 illustrates a schematic view of a downhole tool operated by a control line.
Figure 2A:
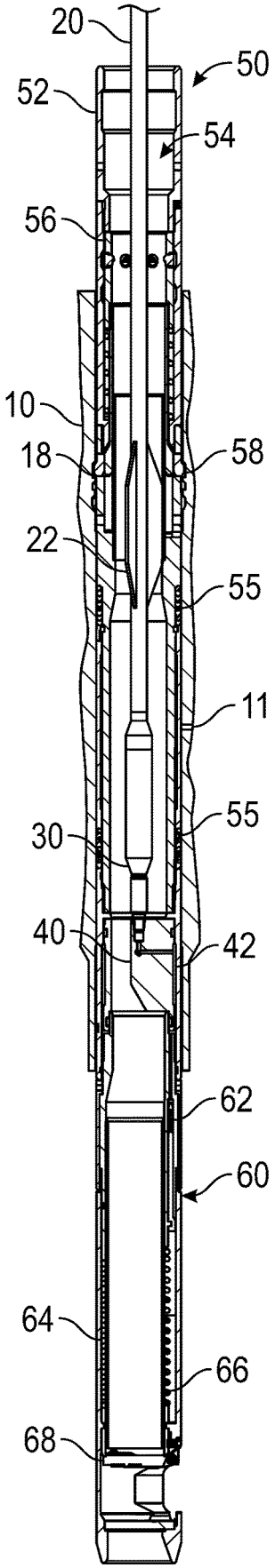
FIG. 2A (Prior Art)
FIG. 2A illustrates a cross-section of a surface-controlled subsurface safety valve according to the prior art.
Figure 2B:
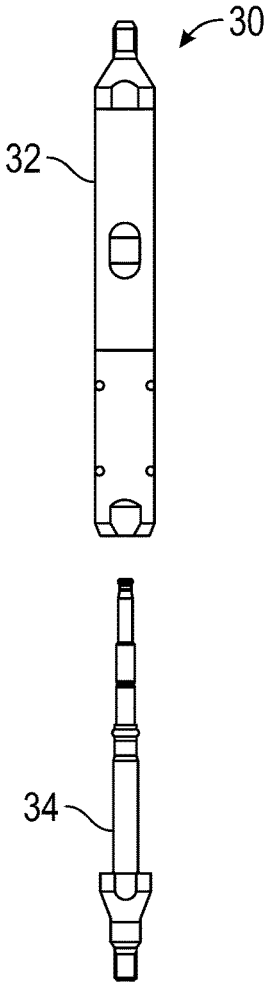
FIG. 2B (Prior Art)
FIG. 2B illustrates an example of male and female members of a hydraulic connector according to the prior art.
Figure 3:
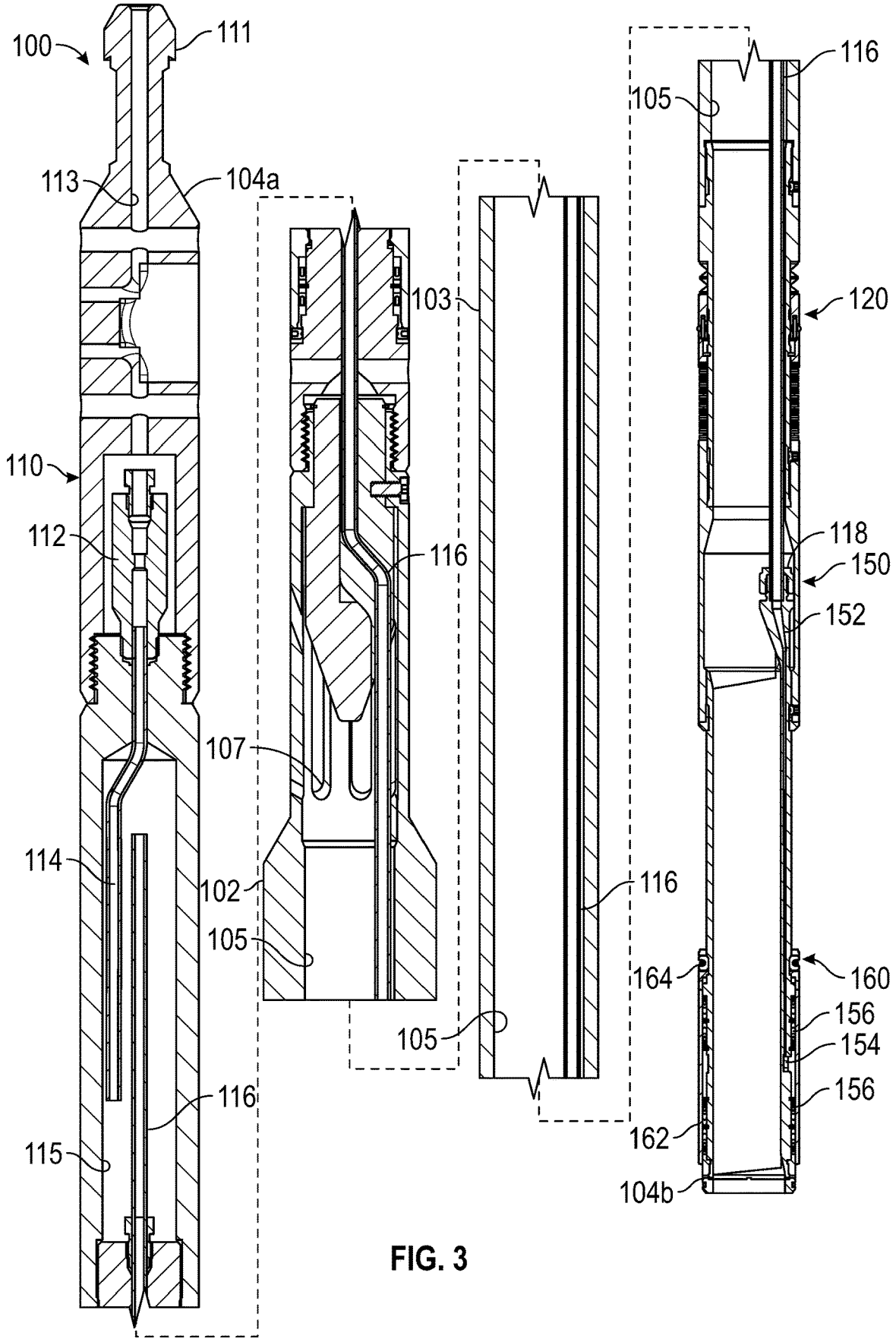
FIG. 3 illustrates a cross-section of a stinger according to the present disclosure for communicating hydraulics to a downhole tool.
Figure 4:
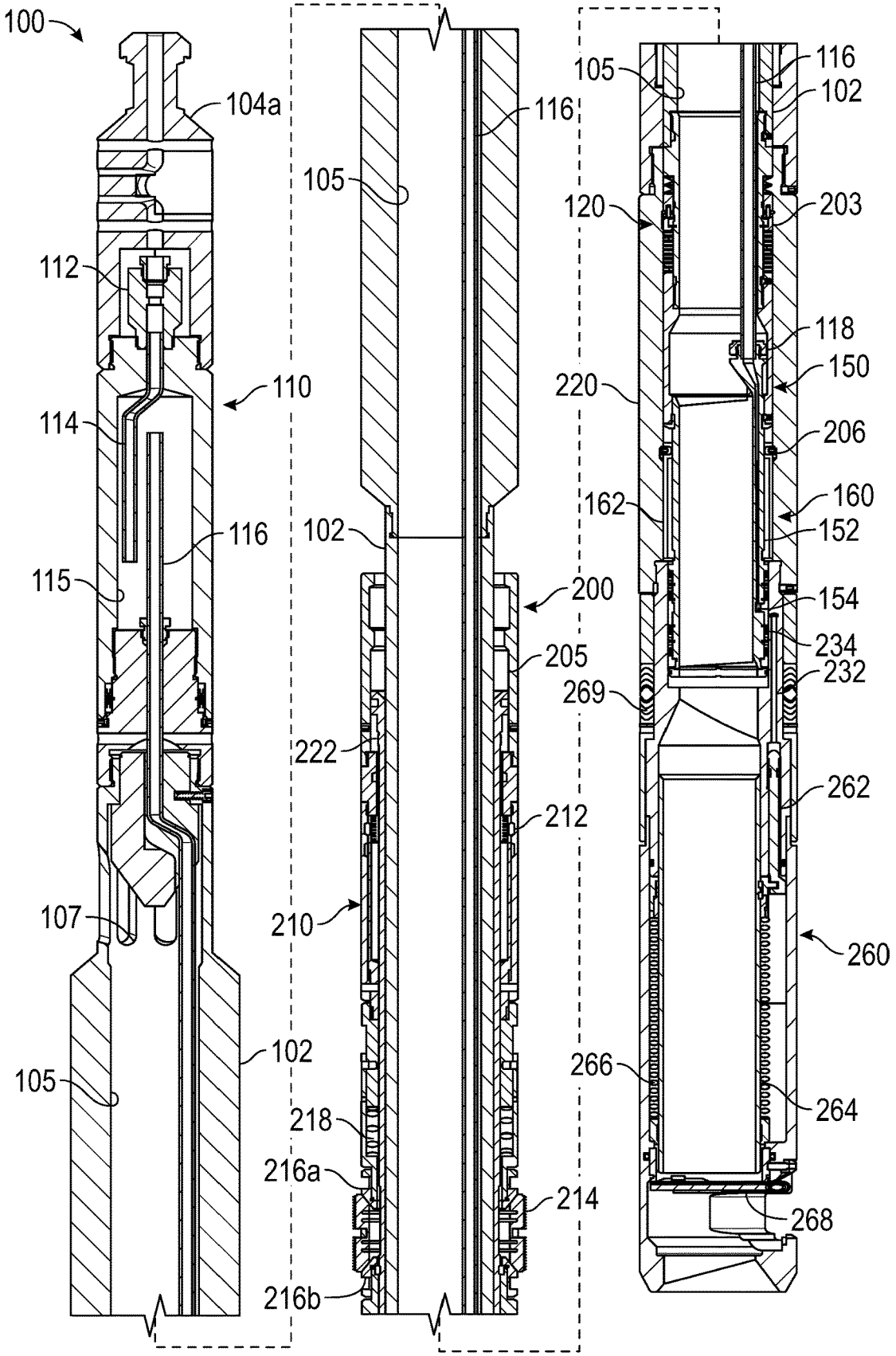
FIG. 4 illustrates a cross-section of the disclosed stinger stabbed into a surface-controlled subsurface safety valve.

FIG. 3 illustrates cross-section of a stinger 100 for communicating fluid (e.g., hydraulics, injection fluid, etc.) from a fluid line to a tool (not shown). As discussed later, the downhole tool can be a surface-controlled, subsurface safety valve operated with hydraulics from a hydraulic control line. For example, FIG. 4 illustrates a cross-section of the disclosed stinger installed in a surface-controlled, subsurface safety valve 200.

As will be appreciated, an existing safety valve in a well may become inoperable. To rectify the problem, operators can deploy a surface-controlled safety valve 200 in the tubing of the well. The surface-controlled safety valve 200 can be landed inside the existing tubing-mounted safety valve, in a tubing-mounted safety valve landing nipple, or in another part of the tubing string depending on the type of surface-controlled safety valve used. Using the stinger 100, a hydraulic control line can then be run down the tubing and connected to the installed valve 200 for operation. As will be appreciated with the benefit of the present disclosure, the disclosed stinger 100 can be used to connect a fluid line to a mandrel, a safety valve, or some other tool.

As shown in FIG. 3, the stinger 100 includes a body or housing 102, which can be made up of various interconnecting components for assembly purposes. Overall, the stinger's body 102 has a proximal end 104*a* and a distal end 104*b* and defines a flow bore 105 therethrough. The body 102 connects to a fluid line (not shown), such as a capillary or control line run from a wellhead hanger at surface. For instance, the proximal end 104*a* can include a wireline head 111 having a line support 113 for the fluid line (not shown) to connect internally to a fluid connection 110. The flow bore 105 allows for flow through the stinger's body 102 between the open distal end 104*b* and flutes 107 at the proximal end 104*a*.

The distal end 104*b* defines a stinger port 154 that communicates with the fluid from the fluid line (not shown) at the proximal end 104*a*. As discussed below, the distal end 104*b* is stabbed into a bore opening of a downhole tool (e.g., safety valve, mandrel, etc.) so the stinger port 154 can be placed in fluid communication with a tool port and can communicate the fluid with the downhole tool for the purposes of the tool.

To communicate the fluid from the fluid line (not shown) at the proximal end 104*a* to the stinger port 154 at the distal end 104*b*, the fluid connection 110 includes a coupling 112 of a first flow passage or conductor 114 to the fluid line (not shown). The first conductor 114 communicates from the coupling 112 to a syphon chamber 115 in the body 102. A second flow passage or conductor 116 communicates the chamber 115 downstream with the external port 154.

The first conductor 114 has a first connected end at the coupling 112 and has a first free end disposed in the syphon chamber 115. The second conductor 116 has a second free end disposed in the syphon chamber 115 and has a second connected end at a second coupling 150. For example, the second conductor 116 can pass along the sidewall of the flow bore 105 of the body 102, and an end of the lower conductor 116 can connect to an internal coupling 150 discussed below, which then communicates internally to the stinger port 154.

The syphon chamber 115 can help keep the control fluid substantially free of debris and contamination. For example, debris will tend to settle to the bottom of the chamber 115. If the stinger 100 is at a grade (i.e., is non-vertical), the chamber 115 will tend to keep the collected debris from inadvertently entering through the open end of the conduit 116 that communicates to the stinger's port 154. should filtering be necessary, the syphon chamber 115 can house filter (not shown) for filtering the control fluid, but filtering may not be suitable in some implementations, such as injection applications.

As shown, the internal coupling 150 is disposed off the central axis in the flow bore 105 of the body 102, which can reduce the restriction to the flow bore 102 and can reduce creation of flow turbulence in production fluid or the like. As also shown in FIG. 3, the body 102 has first and second annular seals 156*a-b* disposed externally about the body 102 with the external port 154 exposed in the external sidewall between the first and second annular seals 156*a-b*.

Sealing of the fluid path along the conduits 114, 116 uses connectors 112, 150 that can have hydraulic fittings to seal the conduits 114, 116. For example, the connectors 112, 150 can have a jam nut and ferrules to crimp and seal the conduit 114, 116 in ports, receptacles, or the like of the stinger's body 102.

Other configurations may not use a syphon chamber 115 with the two conductors 114, 116. Instead, a single conductor can pass from the connection 112 to the other components of the stinger 100. Moreover, it is conceivable that the surface fluid line (not shown) itself can be routed through the proximal end 104*a* of the stinger 100 and can be connected to the other components of the stinger 100, but ease of assembly would prefer the connection 112 be used to the external fluid line, which would typically be run from surface.

Additionally, other configurations may use an internal flow passage 116. As disclosed herein, the second flow passage 116 includes the conduit disposed internally inside the flow bore 105 of the stinger 100 and connected between the upper coupling 112 and the internal coupling 150. This arrangement can facilitate assembly because the stinger 100 can be constructed of several interconnecting components. However, other configurations are possible. For example, given sufficient space in the cylindrical sidewall of the stinger's body 102, given sealed interfaces between the interconnected components of the stinger's body, and given suitable machining/manufacture, the first flow passage 116 may be configured as an internal flow passage extending inside the tool's body 102 from the connection 112 to the fluid line down to the stinger's external port 154.

During use, the stinger 100 stabs into a downhole tool to complete hydraulic connection thereto. For example, FIG. 4 illustrates a cross-section of the disclosed stinger tool 100 stabbed into a flow bore 205, bore opening, or receptacle in the downhole tool 200. As shown here, the downhole tool 200 can be a surface-controlled, subsurface safety valve.

The valve 200 can be set inside a downhole tubular in a manner known in the art. The valve 200 can be deployed down the tubing of the well that has or does not have a safety valve nipple. Depending on the implementation, the valve 200 can be set in the tubing before stabbing by the stinger 100, or the valve 200 can be set with the stinger 200 already stabbed. Here, in this example, the valve 200 is first set downhole in the tubing, and the stinger 100 is then installed to make the hydraulic connection.

For example, the tool 200 shown here is a surface-controlled, subsurface safety valve that is set mechanically downhole in a tubular. Briefly, the safety valve 200 has a housing 202 with a landing portion 210 and a safety valve portion 260. The landing portion 210 on the upper end of the tool 200 is movable on a stem 222 extending from a lower housing portion 220. The landing portion 210 can use slips 214 movable on the housing 202 between engaged and disengaged positions relative a downhole tubular in which the valve 200 lands.

The safety valve portion 260 of the tool 200 is connected below the lower housing 220 and includes the safety valve components noted herein. In general, the valve portion 260 has a flapper 268 rotatably disposed on the housing 202. The flapper 268 rotates on a pivot pin, and a torsion spring biases the flapper 268 to a closed position.

In deploying the valve 200 without the stinger 100 installed, a conventional wireline running tool (not shown) couples to the profile in the upper end of the valve's housing 202 and lowers the valve 200 to the desired location. When in position, the running tool actuates the landing portion 220 to set the tool 200 in a downhole tubular.

To set the tool 200, the upper housing 210 can be moved along the stem 222 toward the lower housing 220, and a body lock ring 212 engaged between the stem 222 and the upper housing 210 can prevent reverse upward movement. Setting the tool 200 can be achieved using known techniques, such as using the wireline setting tool to move the housing 210 and the setting stem 222 relative to one another. In the setting process, the slips 214 engaged between upper and lower cones 216*a-b* between the upper and lower housing 210, 220 can be wedged outward to engage the surrounding surface of the tubular. Bias from a spring 218 on the upper housing 210 can be provided for the upper cone 210 to facilitate the setting. Once landed, one or more external seals, such as chevron seal 269, on the housing 202 can seal against the tubular wall. Other configurations for setting the tool 200 can be used.

Either way, the surface-controlled subsurface safety valve 200 can be installed in a well that either has or does not have existing hardware for a surface-controlled valve. Coil tubing or other fluid line can then be run downhole so the disclosed stinger 100 can connect to the valve 200 and communicate hydraulic fluid to the valve 200 for operation.

With the valve 200 landed, for example, operators lower a fluid line or capillary string (not shown) with the stinger 100 on the end downhole to the valve 200. This capillary string can be hung from a capillary hanger (not shown) at the surface. The string 100's distal end 104*b* passes into the bore 205 of the valve's housing 202 and makes connection inside the valve 200 to control the valve 200 hydraulically.

In particular as shown in FIG. 3, once the stinger 100 in stabbed into the valve 200, the capillary string communicates with an internal port 234 defined in a sidewall inside the flow bore 205 of the valve 200. Production flow can travel through the flow bore of the stinger, and less internal restrictions inside the flow bore can reduce turbulence.

Pressurized hydraulic fluid can be delivered through the capillary string, through the stinger 100, and into the valve 200. As the fluid reaches the internal port 234, it can engage an internal piston 262 to move the piston 262 downward against the bias of the spring 266 and shift an inner sleeve 264 to force open the flapper 268. In this way, the valve portion 260 can operate in a conventional manner. As long as hydraulic pressure is supplied to the piston 262 via the capillary string 20, for example, the inner sleeve 264 maintains the flapper 268 open, thereby permitting fluid communication through the valve's housing 202. When hydraulic pressure is released due to an unexpected up flow or the like, the spring 266 moves the inner sleeve 264 away from the flapper 268, and the flapper 268 is biased shut by its torsion spring, thereby sealing fluid communication through the valve's housing 202.

Turning to details of the stinger 100 and its insertion into the tool, FIGS. 5, 5A-5C, 6, and 7 show isolated sections of the stinger 100 and valve 200 of FIG. 3.

Figure 5:
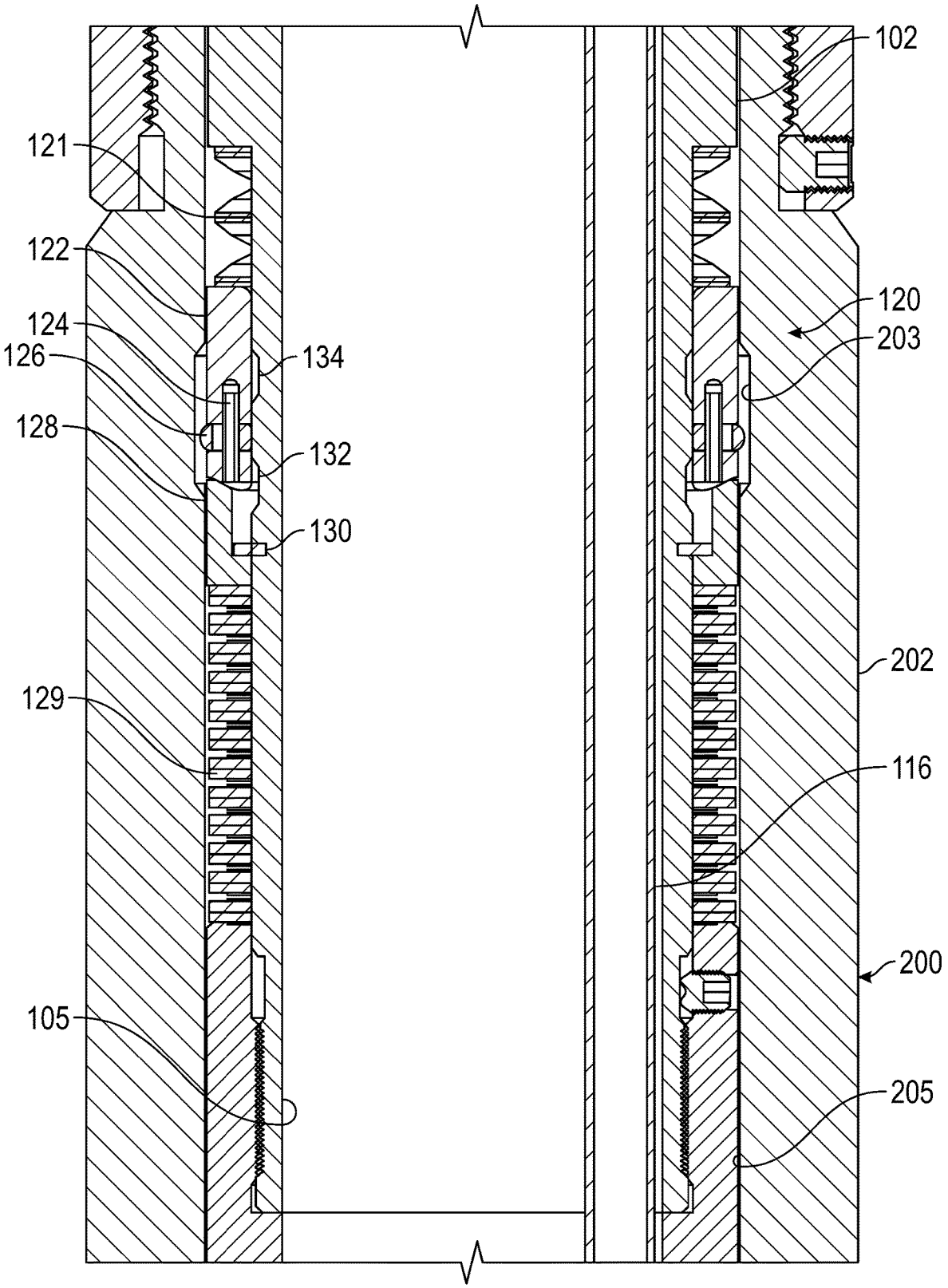
FIGS. 5 and 5A-5C illustrate an isolated section of FIG. 3, highlighting particular details associated with a lock of the stinger.

FIG. 5 illustrates a lock 120 of the disclosed stinger 100. The lock 120 uses a strong spring and key configuration to retain the stinger 100 in the tool 200. As shown, the lock 120 includes a drag collar 122 movably disposed on the body 102 and biased toward a first position on the body 102. In particular, a first biasing element 121 pushes the drag collar 122 toward a push collar 128, which is itself pushed in an opposite direction by a second biasing element 129 The biasing elements 121, 129 can be wire springs, wave springs, set of bevel springs, set of disc springs, or the like. A snap ring 130 on the tool body 102 prevents further movement of the push collar 128 past it. The drag collar 122 includes a shifting dog 126 disposed on the collar 122. In particular, the shifting dog 126 can shift between an extended condition and a retracted condition on a cross pin 124 of the drag collar 122. A plurality of such shifting dogs 126 may be arranged around the circumference of the drag collar 122.

For its part, the stinger body 102 defines first and second external grooves 132, 134 spaced from one another. Depending on the how the dogs 126 are shifted by the sidewall the bore opening 205 of the tool body 202, the dogs 126 can shift to the retracted condition into either of the first and second external grooves 132, 134. Moreover, depending on how the dogs 126 are shifted by the sidewall the stinger body 102, the dogs 126 can shift to the extended condition into the internal groove 203 of the tool's bore opening 205.

Figures 5A, 5B, 5C:
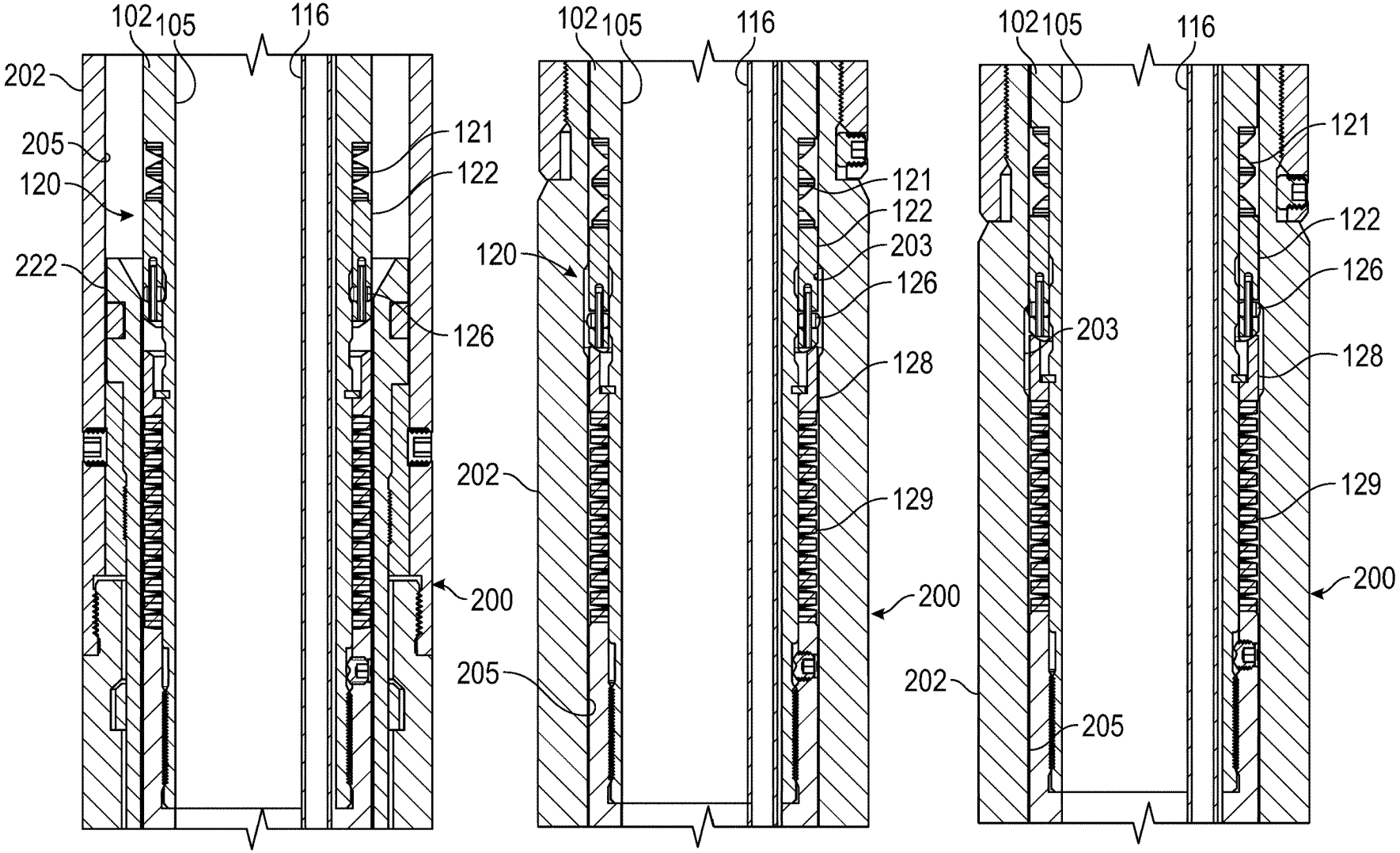

In FIG. 5A, the lock 120 of the stinger 110 is shown during insertion of the stinger body 102 into the tool 200. During insertion before the stinger 100 enters the tool 200, the drag collar 122 is arranged by the bias to an intermediate position with the dogs 126 between the external grooves 132, 134 so that the shifting dogs 126 extend outward. When the stinger 100 enters the tool's bore opening 205, however, the extended dogs 126 engage the upper shoulder of the tool 200—namely an end of the stem 222 of a portion of the housing forming part of the bore opening 205 of the tool 200. Insertion of the stinger 100 forces the drag collar 122 up against the upper biasing element 121 until the dogs 126 reach the upper external groove 134 on the stinger body 102. The dogs 126 are shifted to the retracted condition in the upper groove 132, and the stinger body 102 can pass further into the tool's bore opening 205. The drag collar 122 is held with the dogs 126 in the upper groove 134.

Eventually during the insertion, the lock 120 reaches the position shown in FIG. 5B where the internal groove 203 of the tool's bore opening 205 is located. In FIG. 5B, the lock 120 of the stinger 110 is shown engaged inside the bore opening 205 of the tool's housing 202. The bore opening 205 of the tool 200 defines the internal groove 203. With the dogs 126 able to extend, the bias of the upper spring 121 pushes the drag collar 122 back to its intermediate condition set against the push collar 128.

As shown in FIG. 5C, the lock 120 resists removal of the stinger body 102 form the tool 200. When the stinger body 102 is moved or pulled out of the bore opening 205 of the tool 200, the extended dogs 126 engage the upper edge of the internal groove 203. Pulling must exceed the bias against the lower push ring 128 so the drag collar 122 and push ring 128 can shift down against the lower biasing element 129. The dogs 126 will reach the lower external groove 132 and retract therein, releasing the lock 120 from the internal groove 203 and allowing removal of the stinger body 102 from the tool's bore opening 205.

Figure 6:
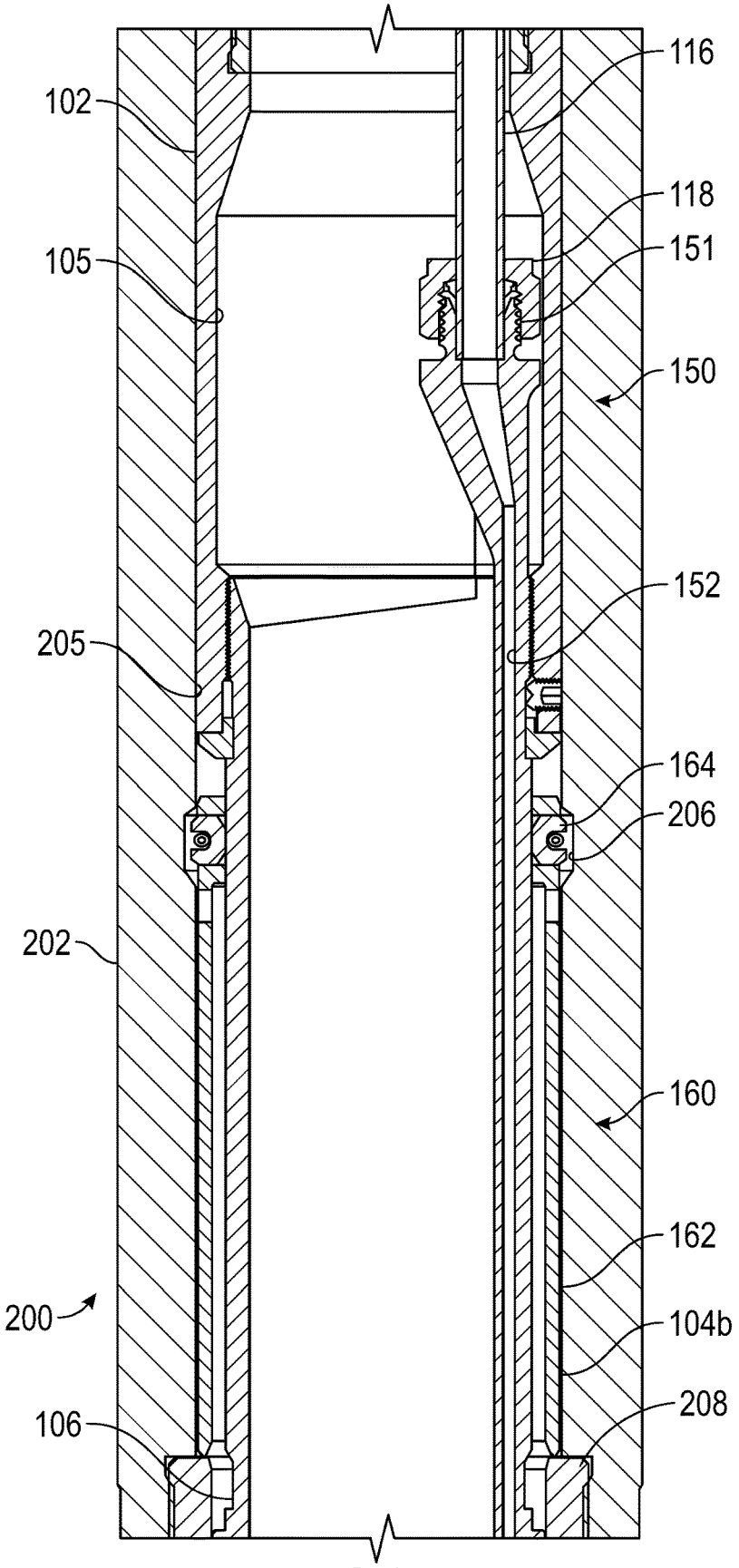
FIG. 6 illustrates an isolated section of FIG. 3, highlighting particular details associated with protective sleeve and connection of the stinger.

In FIG. 6, the internal coupling 150 disposed in the stinger's flow bore 105 is shown. The flow conduit 116 that runs along the flow bore 105 connects by a fitting 118 to an exposed fitting head 151 inside the flow bore 105. An internal flow passage 152 in the stinger's body 102 passes from the fitting head 151 to the stinger port (154), which is shown and described with reference to FIG. 7.

Additionally in FIG. 6, a closure 160 near the distal end 104*b* is shown engaged inside the bore 205 of the tool's housing 202. The closure 160 includes a sleeve 162 disposed about the stinger body 102. The sleeve 162 is movable on the distal end 104*b* and moves an annular catch or keys 164. The closure 160 can serve to protect the seals 156*a-b* during running of the stinger 100, but also to close off the port 154. During run-in or pull-out of the stinger 100, the sleeve 162 covers the seals 156*a-b* and closes off fluid communication from the port 154. This prevents damage, contamination, or leaking of control fluid.

When the distal end 104*b* is inserted into the tool's bore opening 205, the catch 164 is initially engaged in an external groove 106 at the distal end 104*b* of the stinger body 102 with the sleeve 162 covering and protecting the annular seals 156*a-b* as the stinger body 102 is inserted.

During insertion, a lip of the sleeve 162 engages a shoulder 208 inside the tool's bore opening 205. The catch 164 releases from the external groove 106 and can engage in an annular groove 206 in the bore opening 205 of the downhole tool 200. The catch 164 can include a set of biased keys disposed about the sleeve 162. During removal of the stinger body 102, the catch 164 can hold the sleeve 162 in place until the stinger's external groove 106 reaches the catch 164 and the sleeve 162 can be pulled out of the tool's bore opening 205 together with the rest of the stinger body 102.

Figure 7:
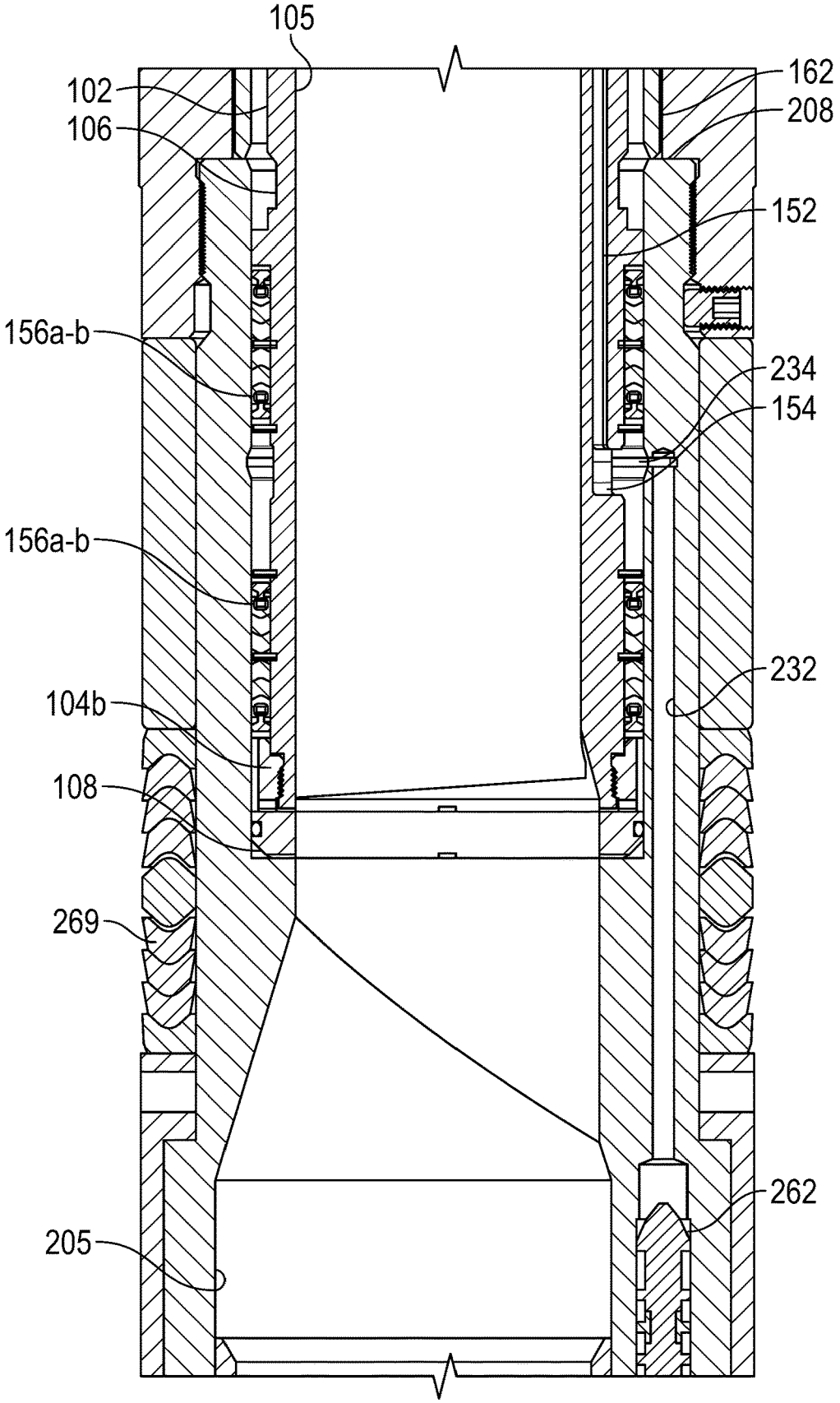
FIG. 7 illustrates an isolated section of FIG. 3, highlighting particular details associated with the sealed engagement of the stinger.

In FIG. 7, the stinger port 154 of the stinger 100 is shown in sealed engagement with the tool's internal port 234 for communicating the hydraulic fluids. As shown, the distal end 104*b* of the stinger 100 is cylindrical to fit into the diameter of the tool's bore opening 205 so that the flow bore 105 of the stinger body 102 can communicate with the bore 205 of the tool 200 without significant obstruction to the flow area. As shown, the distal end 104*b* may include a bushing 108 and annular seal to facilitate insertion and sealing of the distal end 104*b* inside the bore opening 205 of the tool 200.

The stinger port 154 is defined in the outer cylinder surface of the stinger body 102. The first and second annular seals 156*a-b* are arranged above and below the port 154 to sealably engage inside the tool's bore opening 105 and seal an annular space for the stinger port 154 to communicate with the tool's internal port 234. The seals 156*a-b* can be chevron seals or the like. Fluid from the flow passage 152 can be communicated out the stinger port 154 and into the tool's internal port 234 in order to pass further inside the tool's flow passage 232 for the purposes disclosed herein, such as passing to the piston 262 in the tool 200.

As disclosed above, the stinger 100 of the present disclosure can be used for communicating hydraulics to a downhole tool operated by hydraulics. As shown in the present examples, the tool can be a surface-controlled, subsurface safety valve. As will be appreciated, the disclosed stinger 100 can be used with other hydraulically operated tools operated by hydraulics from a fluid line.

Figure 8A:
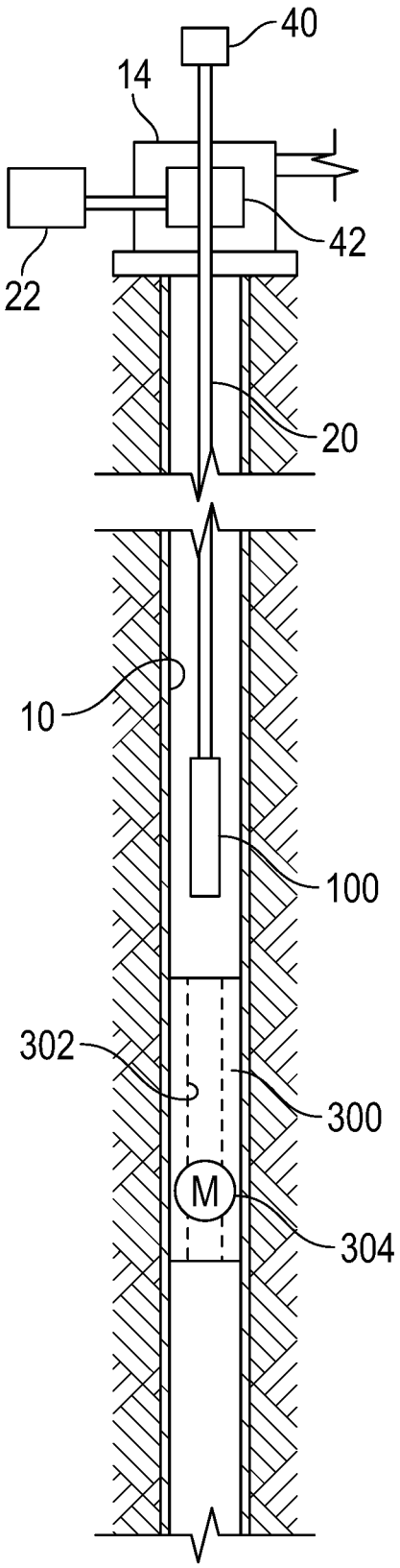
FIG. 8A illustrates a schematic view of the disclosed stinger during deployment to a hydraulically operated downhole tool.

For instance, FIG. 8A illustrates a schematic view of the disclosed stinger 100 during deployment to a hydraulically-operated downhole tool 300. In general, the downhole tool 300 can be any hydraulically-operated tool having a through-bore or bore opening 302 and having a hydraulic mechanism 304, such as a piston, valve, etc. The tool 300 is shown disposed with (i.e., disposed in association with, disposed on, or disposed in) tubing or casing 10. For example, the tool 300 can be run in and set in the tubing or casing 10 using setting features, such as used for the safety valve disclosed herein. Alternatively, the tool 300 can be run on the tubing or casing 10 during deployment of the tubing or casing 10.

Regardless of how the tool 300 is run and set, the stinger 100 is run through the wellhead 14 on a capillary line 20 hanging from a hanger 40, and the stinger 100 is run down through the tubing 10, which can be a casing string, production string, etc. At surface, the hanger 40 of the control line 20 lands in a head or a bowl 42 of the wellhead 14 so the hydraulic system 22 at surface can communicate with the capillary line 20 to control the downhole tool 300.

Downhole, the stinger 100 stabs into the bore opening 302 of the tool 300 to make the hydraulic connection as disclosed herein. The tool 300 therefore includes features similar to those disclosed herein with respect to the safety valve (200) for receiving the stinger 100. In general, for example, the tool 300 includes some form of upper shoulder in its bore opening (205), an internal groove (203) for engaging the stinger's lock (120), an annular groove (206) for engaging the closure's catch (164), a shoulder (208) for engaging the stinger's sleeve (162), and an internal port (234) for communicating hydraulics with the stinger's port (154).

Other than control fluids, such as hydraulics, the disclosed stinger 100 can communicate other fluids, such as injection fluids or the like, for communicating with a downhole component, such as an injection mandrel. For example, the fluid line can be used to provide chemicals to a deepset injection mandrel or nipple.

Figure 8B:
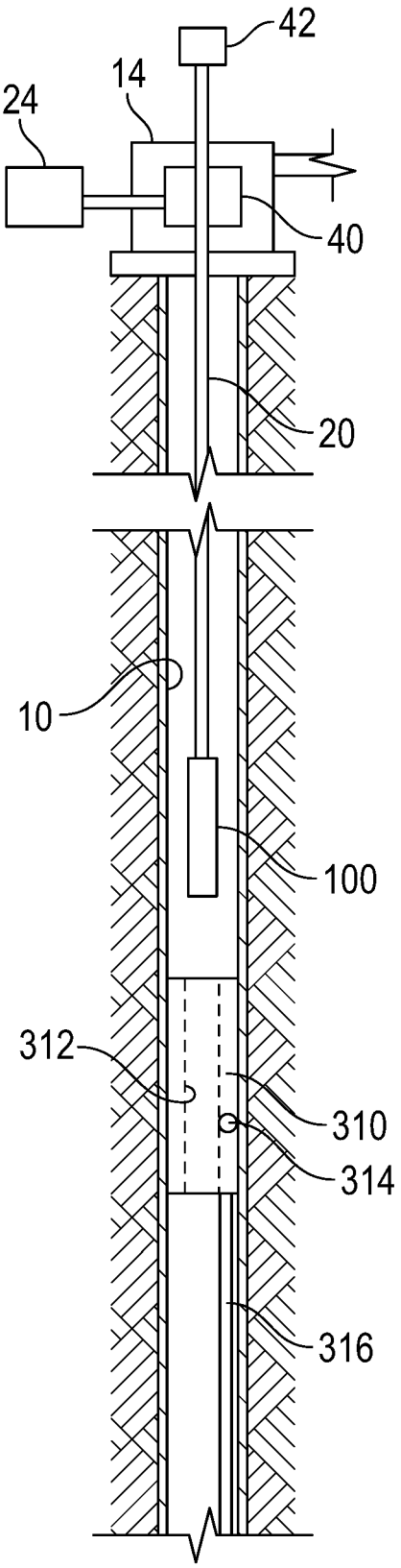
FIG. 8B illustrates a schematic view of the disclosed stinger during deployment to an injection mandrel.

For instance, FIG. 8B illustrates a schematic view of the disclosed stinger 100 during deployment to an injection mandrel 310. In general, the injection mandrel 310 can include a mandrel port (not shown) in communication with a valve 314 configured to control injection of chemicals through an injection line 316 extending from the mandrel 310.

As before, the mandrel 310 is shown disposed with (i.e., disposed in association with, disposed on, or disposed in) tubing or casing 10. For example, the mandrel 310 can be run in and set in the tubing or casing 10 using setting features, such as used for the safety valve disclosed herein. Alternatively, the mandrel 310 can be run on the tubing or casing 10.

Regardless of how the mandrel 310 is set, the stinger 100 is run through the wellhead 14 on a capillary line 20 hanging from a hanger 40, and the stinger 100 is run down through the tubing 10, which can be a casing string, production string, etc. At surface, the hanger 40 of the capillary line 20 lands in a head or bowl 42 of the wellhead 14 so an injection system 24 at surface can communicate with the capillary line 20 to feed the mandrel 310.

Downhole, the stinger 100 stabs into the bore opening 312 of the mandrel 310 to make the fluid connection as disclosed herein. The mandrel 310 therefore includes features similar to those disclosed herein with respect to the safety valve (200) for receiving the stinger 100. In general, for example, the mandrel 310 includes some form of upper shoulder in its bore opening (205), an internal groove (203) for engaging the stinger's lock (120), an annular groove (206) for engaging the closure's catch (164), a shoulder (208) for engaging the stinger's sleeve (162), and an internal port (234) for communicating injection chemicals with the stinger's port (154).

Additionally or alternatively, the stinger 100 of the present disclosure can be used for communicating hydraulics or other fluids in a reverse direction, i.e., from a downhole tool, mandrel, or the like, to a fluid line running inside a tubing string. With the benefit of the present disclosure, these and other implementations will be recognized by one skilled in the art.

As disclosed herein, a control fluid, hydraulic fluid, or other injectable fluid is delivered between a fluid line and a tool port in a longitudinal flow bore of a mandrel, a safety valve, or other downhole tool. A stinger includes a longitudinal bore and stabs into the tool's flow bore. The stinger provides a communication passageway for facilitating fluid communication between the fluid line and the tool port inside the downhole tool. The downhole tool can have a hydraulic chamber (to control a safety valve or other mechanism) or can have an injection tubing string. A stinger port in the longitudinal bore of the stinger communicates with the tool port inside the tool bore, while the bore through the stinger can communicate flow with the bore of the tool. In this way, the internal flow area through the downhole tool is preferably maximized to reduce any restriction and turbulence through the flow bore.

The stinger locks and seals on an internal diameter of the downhole tool into which the stinger is stabbed. As noted in the background, current methods sting a coupling into a receiver that is positioned in the center of a tool's flow bore, which can create turbulent flow that results in vibration and erosion. The arrangement of the present disclosure reduces flow obstruction by putting the stinger on the outside of the flow.

As also noted in the background, current methods use single, small sealing diameter seals in a coupling. The disclosed stinger uses a larger, multi-seal more stable/reliable seal system. Moreover, the disclosed stinger uses a spring-loaded lock arrangement for engaging with the internal diameter of the tool's flow bore. The arrangement provides stronger locking because the flow is not pushing directly on the stinger.

The locking system uses compression springs (wave springs, wire springs, disc springs, etc.) and locking dogs. This increases stability of the production flow, because of decreased turbulence. A reduction in turbulence may also lead to less vibration in the system, increasing the seal life in the system. A long polish bore inside the tool allows the stinger to use a multi-seal type stack, which increases reliability of the sealing at the same time.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A stinger for communicating fluid between a fluid line and a downhole tool, the downhole tool disposed with tubing, the fluid line running through the tubing, the downhole tool having a tool bore for passage of tubing flow therethrough, the tool bore defining a tool port and an internal groove in an internal surface of the tool bore, the stinger comprising:

a body having a proximal end and a distal end and defining a body bore for passage of the tubing flow therethrough between the proximal and distal ends, the body having a flow passage therein in communication with the fluid line, the body having a stinger port in an external surface of the body, the stinger port in communication with the flow passage, the body defining first and second external grooves on the external surface, the body being configured to insert at least partially into the tool bore of the downhole tool, the body bore being configured to communicate with the tool bore for the passage of the tubing flow therethrough, the stinger port in the external surface being configured to position in fluid communication with the tool port in the internal surface, wherein the stinger comprises a lock disposed on the external surface of the body, the lock having a dog being movable between the first and second external grooves and being shiftable between extended and retracted conditions, the dog moved to either of the first and second external grooves being shifted in the retracted condition, the dog moved between the first and second external grooves being shifted in the extended condition and being engageable in the internal groove in the tool bore.

2. The stinger of claim 1, wherein the flow passage comprises a first connection disposed toward the proximal end, the first connection configured to connect the flow passage to the fluid line.

3. The stinger of claim 2, wherein the flow passage comprises:

a chamber defined in the body;

a first portion of the flow passage communicating the first connection with the chamber; and a second portion of the flow passage communicating the chamber with the stinger port.

4. The stinger of claim 3, wherein the first portion of the flow passage comprises a first conductor having a first connected end and a first free end, the first connected end disposed in communication with the first connection to the fluid line, the first free end disposed in the chamber.

5. The stinger of claim 4, wherein the second portion of the flow passage comprises a second conductor disposed at least partially in the body bore of the body, the second conductor having a second free end and a second connected end, the second free end disposed in the chamber, the second connected end disposed in communication with the stinger port.

6. The stinger of claim 5, wherein the body bore of the body comprises a second connection disposed off a central axis in the body bore, the flow passage of the body including an internal channel defined in the body, the second connection connected to the second connected end of the second conduit and communicating through the internal channel with the stinger port.

7. The stinger of claim 1, wherein the body comprises first and second annular seals disposed about the external surface of the body, the stinger port exposed in the external surface between the first and second seals.

8. The stinger of claim 7, wherein the distal end of the body comprises a sleeve disposed thereabout and being movable on the distal end between covered and uncovered positions relative to the first and second annular seals.

9. The stinger of claim 8, wherein the sleeve comprises a dog engageable with an internal groove in the tool bore of the downhole tool.

10. The stinger of claim 1, wherein the lock comprises:

a collar movably disposed on the body;

the dog disposed on the collar and being shiftable between the extended condition and the retracted condition on the collar, the collar in an intermediate position on the body having the dog shifted in the extended condition between the first and second external grooves, the collar being moved in either direction from the intermediate position having the dog shifted by the tool bore to the retracted condition into either of the first and second external grooves.

11. The stinger of claim 10, wherein the lock comprises:

a first biasing element having a first bias, the first bias acting against the collar in a first direction toward the intermediate position and being reactive in a second, opposite direction away from the intermediate position; and a second biasing element having a second bias, the second bias acting against the collar in the second direction toward the intermediate position, the second bias being stopped at the intermediate position and being reactive in the first direction away from the intermediate position.

12. The stinger of claim 11, wherein during the insertion of the body into the tool bore in the first direction, the dog being disposed on the collar in the intermediate position and shifted to the extended condition engages a shoulder in the tool bore, the collar acting against the first bias until the dog shifts to the retracted condition in the first external groove; and wherein during removal of the body from the tool bore in the second direction, the dog being disposed on the collar in the intermediate position and shifted to the extended condition engages the internal groove in the tool bore, the collar acting against the second bias until the dog shifts to the retracted condition in the second external groove.

13. The stinger of claim 1, wherein the proximal end of the body is connected to the fluid line; and wherein the body bore at the proximal end defines a plurality of flutes communicating the body bore out of the body.

14. The stinger of claim 1, wherein the distal end of the stinger is cylindrical, whereby a first diameter of the body bore of the stinger at the distal end mates with a second diameter of the tool bore of the tool.

15. An apparatus for use downhole in tubing having tubing flow, the apparatus comprising:

a tool disposed with the tubing and having a tool bore for passage of the tubing flow therethrough, the tool bore defining a tool port in an internal surface of the tool bore; and a stinger according to claim 1 connected to a fluid line, the stinger disposed in the tubing and defining a flow bore for passage of the tubing flow therethrough, the stinger configured to stab at least partially into the tool bore and configured to communicate fluid between the fluid line and the tool port of the tool.

16. The apparatus of claim 15, wherein the tool comprises an injection mandrel, the tool port in communication with a valve of the injection mandrel configured to control injection of chemical from the fluid line.

17. The apparatus of claim 15, wherein the tool comprises a valve being operable by the fluid from the fluid line to open and closed fluid communication through the tool bore.

18. The apparatus of claim 17, wherein the valve comprises:

a receptacle defined in the tool bore configured to receive a distal end of the stinger, the receptacle having the tool port;

a flapper disposed in the tool bore and being pivotable between opened and closed positions relative to the tool bore;

a sleeve disposed in the tool bore and being movable therein to pivot the flapper between the opened and closed positions; and a piston connected to the sleeve and being in fluid communication with the tool port.

19. The apparatus of claim 15, wherein the tool disposed with the tubing is disposed on the tubing or disposed in the tubing.

20. A method communicating fluid between a fluid line and a downhole tool disposed with tubing, the downhole tool having a tool bore for passage of tubing flow therethrough, the tool bore defining a tool port and an internal groove in an internal surface of the tool bore, the method comprising:

connecting a stinger to the fluid line;

stabbing the stinger in the tool bore of the downhole tool;

permitting insertion of the stinger in the tool bore by allowing a lock to move in a first direction from an intermediate position on the stinger in which the lock is extended to a first position on the stinger in which the lock is retracted;

positioning a stinger port in an external surface of the stinger in fluid communication with the tool port in the internal surface of the tool bore;

locking the stinger in the tool bore with the lock by allowing the lock to move back to the intermediate position in which the lock is extended to engage the internal groove in the tool bore;

communicating the fluid through a flow passage in the stinger between the fluid line and the stinger port in fluid communication with the tool port of the downhole tool;

permitting the passage of the tubing flow of the tool bore through a stinger bore defined through the stinger; and permitting removal of the stinger from the tool bore by allowing the lock to move in a second opposite direction from the intermediate position on the stinger in which the lock is extended to a second position on the stinger in which the lock is retracted.

21. The method of claim 20, wherein stabbing the stinger in the tool bore of the downhole tool comprises uncovering seals of the stinger port by retracting a sleeve on the stinger against a shoulder in the tool bore.

22. The method of claim 20, wherein permitting the passage of the tubing flow of the tool bore through the stinger bore defined through the stinger comprises positioning a cylindrical distal end of the stinger in the tool bore and aligning the stinger bore with the tool bore.

23. The method of claim 22, wherein permitting the passage of the tubing flow of the tool bore through the stinger bore defined through the stinger comprises communicating the stinger bore with the tubing through a flute in a proximal end of the stinger connected to the fluid line.

24. The method of claim 20, wherein the stinger has first and second external grooves on the external surface;

wherein permitting the insertion of the stinger in the tool bore comprises allowing a dog of the lock to move on the stinger from the intermediate position to the first external groove and to shift to a retracted condition in the first external groove;

wherein locking the stinger in the tool bore with the lock comprises allowing the dog of the lock to move from the first external groove to the intermediate position between the first and second external grooves and to shift to an extended condition in the internal groove of the tool bore; and wherein permitting the removal of the stinger from the tool bore comprises allowing the dog of the lock to move on the stinger from the intermediate position to the second external groove and to shift to the retracted condition in the second external groove.

25. The method of claim 24, wherein permitting the insertion of the stinger in the tool bore comprises biasing the dog in the first direction toward the intermediate position on the stinger with a first bias, the first bias being reactive in the second opposite direction away from the intermediate position; and wherein permitting the removal of the stinger from the tool bore comprises biasing the dog in the second direction toward the intermediate position on the stinger with a second bias, the second bias being reactive in the first direction away from the intermediate position.

* * * * *